US006520660B1

(12) United States Patent
Ho

(10) Patent No.: US 6,520,660 B1
(45) Date of Patent: Feb. 18, 2003

(54) FLASHLIGHT HAVING MECHANISM FOR PREVENTING ELECTRICAL CONTACT MEMBERS THEREOF FROM RUSTING

(76) Inventor: Chiu Ming Ho, No. 20, Alley 59, Si-Ser Rd., Chinshoei Town, Taichung County (TW)

( * ) Notice: Subject to any disclaimer, the term of this patent is extended or adjusted under 35 U.S.C. 154(b) by 0 days.

(21) Appl. No.: 09/942,177

(22) Filed: Aug. 28, 2001

(51) Int. Cl.[7] ..... F21L 19/00

(52) U.S. Cl. ..... 362/171; 362/171; 362/203; 362/204; 362/205; 362/202; 362/188; 362/189

(58) Field of Search ..... 362/203, 204, 362/205, 202, 188, 189

(56) References Cited

U.S. PATENT DOCUMENTS 4,433,365 A * 2/1984 Rousseau ..... 200/60
5,865,525 A * 2/1999 Kibler et al. ..... 362/187
5,904,414 A * 5/1999 Monteleone et al. ..... 362/202

* cited by examiner

*Primary Examiner*—Stephen Husar
*Assistant Examiner*—Bertrand Zeade
(74) *Attorney, Agent, or Firm*—Pro-Techtor International Services

(57) ABSTRACT

A flashlight having a mechanism for preventing electrical contact members thereof from rusting comprises a battery frame including a plurality of slanted flexible bifurcation members for receiving one or more batteries, each bifurcation member having a recess proximate the electrode. In an unused position, batteries are disengaged from each other and from a bulb and a conductor coupled to bulb. While in use, by pushing a switch to hold bifurcation members upright in a secured position so.that batteries, bulb, and conductor are electrically coupled together with electrodes and a protuberance of conductor inserted through recesses, thereby forming a circuit from bulb to conductor via batteries.

1 Claim, 3 Drawing Sheets

FLASHLIGHT HAVING MECHANISM FOR PREVENTING ELECTRICAL CONTACT MEMBERS THEREOF FROM RUSTING

FIELD OF THE INVENTION

The present invention relates to flashlights and more particularly to such a flashlight having mechanism for preventing electrical contact member thereof from rusting.

BACKGROUND OF THE INVENTION

Conventionally, flashlight is operated by one or more batteries. Also, batteries are typically installed in flashlight in an unused state. Hence, in a special condition such as power out people may use flashlight immediately. It is known that circuit may not form in a single uninstalled battery. However, circuits may still form between battery and coupled bulb and between battery and coupled conductor of flashlight (e.g., negative electrode) even flashlight is not used. As a result, the contact points (e.g., above positions between battery and bulb and between battery and conductor of flashlight) tend to get rust after a relative long period of time. This can shorten a useful life of flashlight. A proposal is to clean such rest regularly. However, it is inconvenient. To the worse, electrical contact members of flashlight may be damaged during the cleaning if enough care is not taken.

Thus, it is desirable to provide an improved flashlight having mechanism for preventing electrical contact members thereof from rusting in order to overcome the above drawbacks of prior art.

SUMMARY OF THE INVENTION

It is an object of the present invention to provide a flashlight having a mechanism for preventing electrical contact members thereof from rusting comprising a light mechanism including a bulb, a reflector for securing the bulb, an internal threaded section, an elastic member, a flexible substantially L-shaped conductor coupled to the bulb and having protuberance on a vertical section, a battery frame including a horizontal section and a plurality of slanted flexible bifurcation members equally spaced on the horizontal section, each bifurcation member having a recess, and one or more batteries each secured between two of the adjacent bifurcation members with electrodes thereof proximate the recesses; a cylindrical container shaped handle for receiving the conductor, the batteries, and the battery frame and including a collar, a raised switch including a channel, two opposed lugs on one end of the channel, a bent trigger member having a projection on a slanted section and a push button on an open end of the slanted section, and a pin through lugs for pivotably securing the trigger member on the channel; and a cylindrical sleeve mechanism put on the handle and including a front outer threaded section matingly secured to the threaded section of the light mechanism together with the collar and the reflector to enclose the elastic member, and an opening on a surface. In an unused position, the batteries are disengaged from each other, a positive electrode of one of the batteries is disengaged from the bulb, and a negative electrode of the other battery is disengaged from the protuberance. While in a used position, the elastic member is compressed by pushing the push button forward for holding the bifurcation members upright and clinging the projection into the opening so that the batteries are electrically coupled together, the positive electrode of one of the batteries is coupled to the bulb, and the negative electrode of the other battery is coupled to the protuberance by inserting the positive electrodes of the batteries and the protuberance through the recesses, thereby forming a circuit from the bulb to the protuberance via the batteries.

The above and other objects, features and advantages of the present invention will become apparent from the following detailed description taken with the accompanying drawings.

DETAILED DESCRIPTION OF THE PREFERRED EMBODIMENTS

Figure 1:
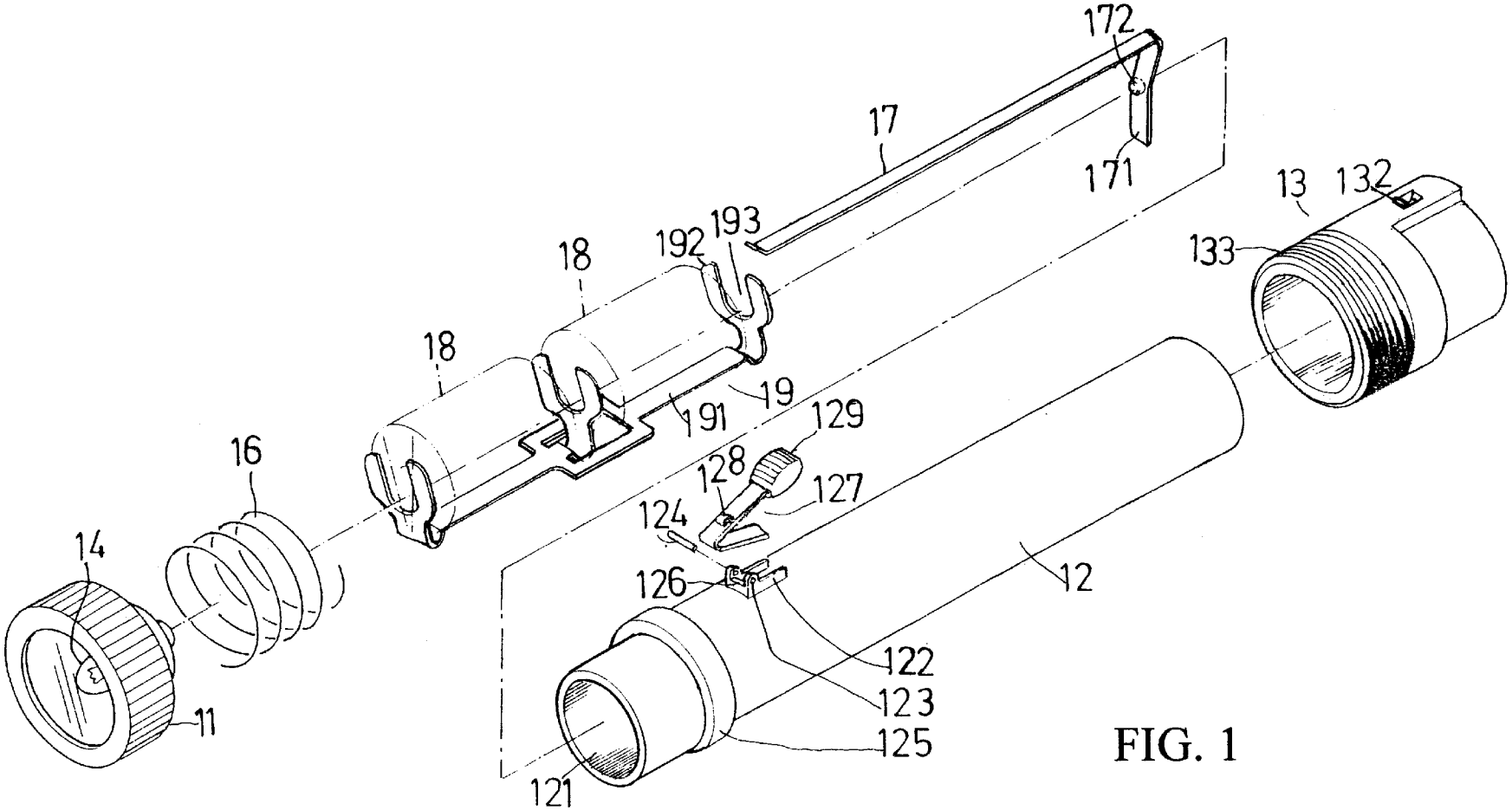
FIG. 1 is an exploded view of a preferred embodiment of flashlight according to the invention.
Figure 2:
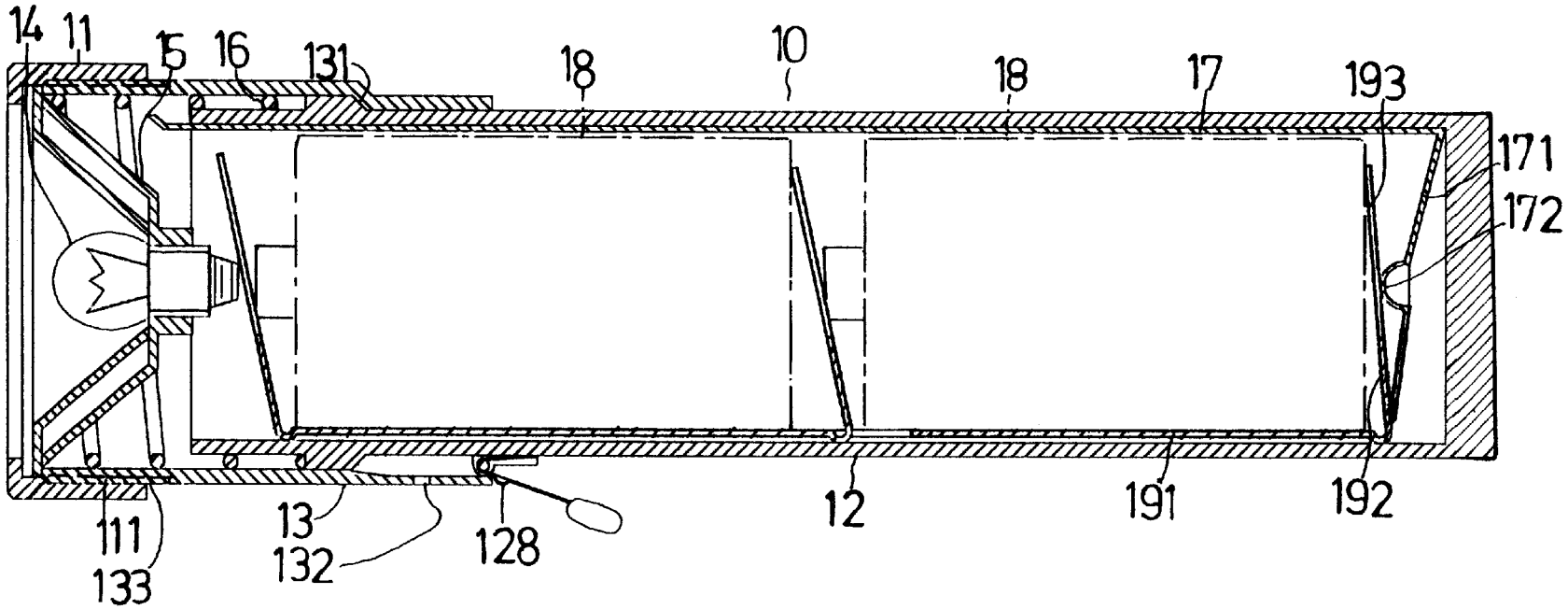
FIG. 2 is a cross-sectional view of the assembled flashlight of FIG. 1 where flashlight is in a used position.
Figure 3:
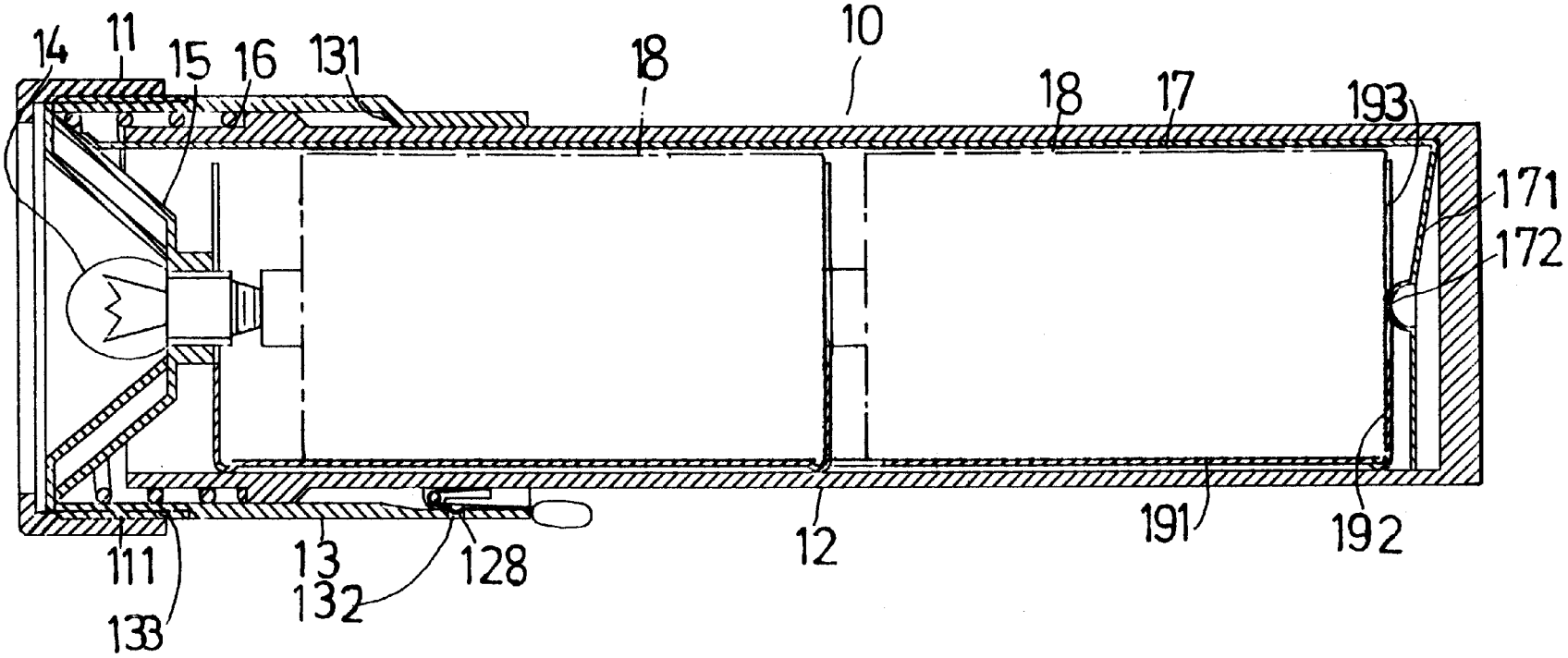
FIG. 3 is a view similar to FIG. 2 where flashlight is in an unused position.

Referring to FIGS. 1 to 3, there is shown a cylindrical flashlight 10 constructed in accordance with the invention comprising a light mechanism 11 including a bulb 14, a cone shaped reflector 15 with bulb 14 secured in one end, an internal threaded section 111, a helical spring 16, a flexible substantially L-shaped conductor 17 coupled to bulb 14 and having a vertical section 171 and a protuberance 172 on vertical section 171, a battery frame 19 including a horizontal section 191 and a plurality of slanted flexible bifurcation members (three and shown) 192 equally spaced on the horizontal section 191, each bifurcation member 192 having a recess 193, and one or more batteries (two are shown) 18 each secured between two adjacent bifurcation members 192 with electrodes thereof proximate recesses 193, a cylindrical container served as handle 12 including a bore 121 for receiving conductor 17, batteries 18, and battery frame 19, a front collar 125, a raised switch 126 including a channel 122, two opposed lugs 123 on one end of channel 122, a bent trigger member 127 having a projection 128 on the slanted section and a push button 129 on the open end of the slanted section, and a pin 124 through lugs 123 for pivotably securing trigger member 127 on channel 122; and a cylindrical sleeve mechanism 13 put on handle 12 and including a front outer threaded section 133 matingly secured to threaded section 111 of light mechanism 11 together with collar 125 and reflector 15 to enclose spring 16, a partially cut-out rear section 131 and an opening 132 on the surface of the partially cut-out rear section 131.

Referring to FIG. 3 specifically, there is shown an unused (i.e., storage) position of flashlight 10 wherein batteries 18 are disengaged from each other, positive electrode of front battery 18 is disengaged from base of bulb 14, and negative electrode of rear battery 18 is disengaged from protuberance 172 due to the slanted bifurcation members 192. As a result, there is no circuit formed from bulb 14 to protuberance 172 through batteries 18, i.e., switch 126 is off. This configuration can prevent electrical contact members e.g., bulb 14, bifurcation members 192, protuberance 172, and batteries 18 from resting in such unused state.

User may push the push button 129 forward for compressing spring 16 and thus holding bifurcation members 192 and vertical section 171 nearly upright until projection 128 is clung into opening 132 (see FIG. 2). At this position, batteries 18 are coupled together (i.e., positive electrode of rear battery 18 coupled to negative electrode of front battery 18), positive electrode of front battery 18 is coupled to base of bulb 14, and negative electrode of rear battery 18 is coupled to protuberance 172 are inserted through recesses 193 to engage with above corresponding components. As a result, a circuit is formed from bulb 14 to protuberance 172 through batteries 18, i.e., switch 126 is on. It is understood that user may press projection 128 to clear from opening 132 prior to pulling the pushing button 129 back to unused position, i.e., switch 126 is off again.

While the invention herein disclosed has been described by means of specific embodiments, numerous modifications and vanations could be made thereto by those skilled in the art without departing from the scope and spirit of the invention set forth in the claims.

What is claimed is:

1. A flashlight having a mechanism for preventing electrical contact members thereof from rusting comprising:

a light mechanism including a bulb, a reflector for securing the bulb, an internal threaded section, an elastic member, a flexible substantially L-shaped conductor coupled to the bulb and having a protuberance on a vertical section, a battery frame including a horizontal section and a plurality of slanted flexible bifurcation members equally spaced on the horizontal section, each bifurcation member having a recess, and one or more batteries each secured between two of the adjacent bifurcation members with electrodes thereof proximate the recesses;

a cylindrical container shaped handle for receiving the conductor, the batteries, and the battery frame and including a collar, a raised switch including a channel, two opposed lugs on one end of the channel, a bent trigger member having a projection on a slanted section and a push button on an open end of the slanted section, and a pin through lugs for pivotably securing the trigger member on the channel; and a cylindrical sleeve mechanism put on the handle and including a front outer threaded section matingly secured to the threaded section of the light mechanism together with the collar and the reflector to enclose the elastic member, and an opening on a surface;

wherein in an unused position, the batteries are disengaged from each other, a positive electrode of one of the batteries is disengaged from the bulb, and a negative electrode of the other battery is disengaged from the protuberance; and in a used position, the elastic member is compressed by pushing the push button forward for holding the bifurcation members upright and clinging the projection into the opening so that the batteries are electrically coupled together, the positive electrode of one of the batteries is coupled to the bulb, and the negative electrode of the other battery is coupled to the protuberance through the recesses, thereby forming a circuit from the bulb to the protuberance via the batteries.

* * * * *